United States Patent [19]

Braun

[11] Patent Number: 4,528,557

[45] Date of Patent: Jul. 9, 1985

[54] BRUSH WEAR INDICATOR

[75] Inventor: Kenneth E. Braun, Milwaukee, Wis.

[73] Assignee: Helwig Carbon, Inc., Milwaukee, Wis.

[21] Appl. No.: 371,507

[22] Filed: Apr. 23, 1982

[51] Int. Cl.[3] ..... G08B 21/00

[52] U.S. Cl. ..... 340/648; 361/179; 361/205

[58] Field of Search ..... 340/648; 307/116, 308, 307/314, 252 J, 282; 310/249; 361/179, 203, 204, 205; 200/61.4, 61.41; 323/240

[56] References Cited

U.S. PATENT DOCUMENTS 3,535,615 10/1970 Howell et al. ..... 323/240

4,024,525 5/1977 Baumgartner et al. ..... 340/648

4,390,870 6/1983 Michael ..... 340/648

*Primary Examiner*—Stewart J. Levy

*Assistant Examiner*—John E. Chapman, Jr.

*Attorney, Agent, or Firm*—Fred Wiviott

[57] ABSTRACT

A motor brush wear indicator includes a probe embedded in a brush and connected in the primary circuit of a transformer for completing the secondary circuit when the brush has worn to a predetermined degree. An oscilator is coupled to the secondary of the transformer which in turn is connected to the gate of an SCR for providing a gate signal when the primary circuit is completed. A relay is connected to the anode-cathode circuit of the SCR for operating an indicating device when the SCR becomes conductive.

10 Claims, 2 Drawing Figures

B+
44
42
40
41
36
52
38
32
30
34
16
LED-1
LED-2
R4
C5
SCR
C2
D1
20
14
R1
C4
C3
R3
R2
26
24
T1
28
29
C1
L1
12
18
10
19
+
48
56
53
46
B+

BRUSH WEAR INDICATOR

BACKGROUND OF THE INVENTION

This invention relates to carbon brush holders for rotating electrical machinery.

Rotating electrical machinery such as motors and generators generally include commutators which are engaged by carbon brushes for connecting the machinery to external circuitry. Such brushes are normally mounted in a brush holder and are spring vised into engagement with the commutator. It is common practice to provide electrical contact devices which indicate when the brush has worn to the degree requiring replacement. Such prior art brush wear indicators commonly include a contacting member mounted on the brush and movable toward engagement with a second contact member as the brush wears.

SUMMARY OF THE INVENTION

The primary object of the invention is to provide a new and improved brush wear indicator.

Another object of the invention is to provide a brush wear indicator which is not sensitive to noise or the voltage of the machinery being protected.

A further object of the invention is to provide a brush wear indicator which is powered externally of the motor being protected.

These and other objects and advantages of the present invention will become apparent from the detailed description thereof taken with the accompanying drawings.

In general terms, the invention comprises a brush wear indicator including a probe associated with the brush. The probe is constructed and arranged to complete a signal circuit when the brush is worn to a predetermined degree. A trigger circuit is responsive to the completion of the signal circuit to produce a trigger signal when the signal circuit is complete. In addition, there is a switching circuit coupled to the trigger circuit and to the indicating circuit and being operable to actuate the indicating circuit upon the occurrence of a trigger signal.

More specifically, the trigger circuit includes a current signal source and an inductive device in circuit between the current signal source and the switching circuit, the inductive device being unsaturated by the current signal when the signal circuit is open and being saturated upon the completion of said signal circuit. The inductive device comprises a transformer having a first winding coupled to the probe and a second winding in circuit between the current signal source and said switching circuit. Additionally, the switching circuit includes a silicon controlled rectifier having a gate coupled to the trigger circuit and an anode and cathode circuit coupled to the transformer secondary winding. The current signal source comprises an oscillator for providing a signal at a preselected frequency, and an impedence circuit coupled to the oscillator and tuned to the frequency thereof. Also included as part of the indicating circuit are first and second light emitting diodes and a relay having normally closed contacts for energizing the first light emitted diode and normally open contacts for preventing the actuation of the second light emitting diode with the silicon controlled rectifier being operative to step said relay contacts upon receipt of a gate signal. A circuit is also provided for intermittently energizing the second light emitting diode. The probe is embedded in the brush and has insulation disposed therearound with one end of the probe being in a position in the brush of maximum wear and the other end of the probe being in circuit with said trigger circuit. Additionally, the brush is disposed within a metallic brush holder for positioning the same adjacent a motor commutator, the probe being connected to one end of the first transformer winding and the holder being connected to the other end thereof.

DETAILED DESCRIPTION OF THE PREFERRED EMBODIMENT

Figures 1A, 1B:
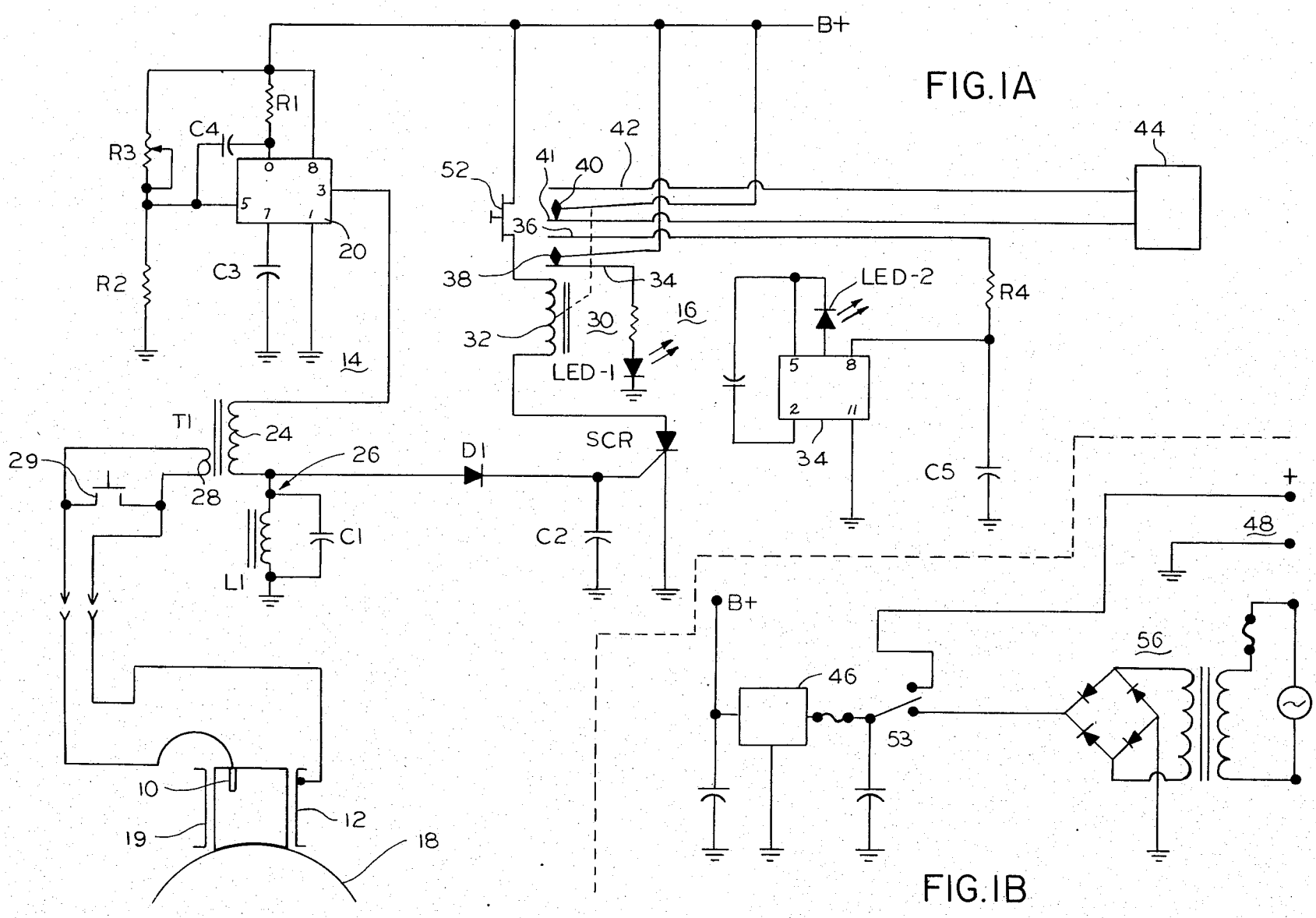
FIGS. 1*a* and 1*b* schematically illustrate the preferred embodiment of the present invention.

The brush wear indicator according to the preferred embodiment of the invention includes a probe 10 embedded in a brush 12. The probe 10 is coupled to a trigger circuit 14 of a silicon controlled rectifier SCR. When the brush has worn a predetermined amount, the circuit is completed to a trigger circuit which fires the SCR to actuate an energizing circuit to a wear indicator circuit 16.

The brush 12 is not shown in detail but those skilled in the art will appreciate that it generally comprises an elongated generally rectangular block of material such as carbon which is held adjacent a motor or generator commutator 18 by means of a hollow tubular brush holder 19. A suitable spring (not shown) engages the outer end of the brush 12 whereby the same is urged into engagement with the commutator 18 so as to maintain electrical engagement as the forward end of the brush wears.

The trigger circuit 14 includes a voltage control oscilator 20 connected to one end of the secondary winding 24 of a transformer T1. The other end of winding 24 is connected to a tuned circuit 26 consisting of a variable inductor L1 connected in parallel to a capacitor C1. In addition, the other end of secondary transformer winding 24 is connected by diode D1 to the gate of a silicon controlled rectifier SCR and to ground through capacitor C2.

The opposite ends of the primary winding 28 of transformer T1 are respectively connected to the probe 10 and to the brush holder 19. The probe consists of a thin member of conductive material which is surrounded by insulation and is embedded in the brush 12. When in this condition, an open circuit exists between the opposite ends of primary transformer winding 28 and as a result the secondary winding 24 unsaturated to block the flow of current. The forward end of the probe 10 is positioned at the point of maximum desired brush wear. After the brush has been worn to that point, the commutator will strip the insulation from the end of the probe 10 thereby completing the circuit between the probe 10 and the brush holder 17. A switch 29 may be connected across winding 28 so that the system may be tested.

The voltage control oscilator 20 includes a first terminal 1 connected to ground; a second terminal 3 connected to the first end of the transformer secondary winding 24; a third terminal 8 connected to the power source B+ which may for example be 12 volts; a fourth terminal 0 which is connected by resistor R1 to B+; a fifth terminal 5 connected between fixed resistor R2 and adjustable resistor R3 forming a bridge connected between ground and B+; and a sixth terminal 7 connected by capacitor C3 to ground. In addition, a capacitor C4 is connected between terminals 0 and 5.

The voltage control oscillator circuit 20 may be set to provide an output signal having a frequency which is equal to the tuned frequency of circuit 26. For example, this frequency may be of the order of 15,100 HZ.

The indicating circuit 16 includes a relay 30 having a coil 32 connected between B+ and the anode-cathode circuit of the silicon controlled rectifier SCR. In addition, a first light emitting diode LED 1 and a light emitting flasher circuit 32 are connected to the normally open contacts 34 and the normally closed contacts 36, respectively, of relay 30. A movable contact member 38 is connected to B+ and is movable from contact 34 to contact 36 when the coil 32 is energized. A second movable contact 40 and fixed contacts 41 and 42 of relay 30 are connected for energizing an audible enunciator 44.

The light emitting flasher circuit 34 includes a first input 8 connected to the junction between a resistor R4 and a capacitor C5 which are in turn connected in series between contact 36 and ground. Each time the voltage across capacitor C5 reaches a predetermined value, circuit 34 is operative to energize light emitting diode 2.

The power supply B+ comprises a power supply regulator 46 which may be selectively coupled by a selector switch 53 to a 12-24 volt DC supply 48 or a rectified alternating current source 50.

In operation, the primary winding 28 of transformer T1 is normally open-circuited because the probe 10 is electrically isolated from the brush holder 19. As a result, no current will flow in the secondary winding 24, the SCR will be nonconductive and relay coil 32 deenergized. The contact 38 of relay 30 will thus be in engagement with contact 34 so that the light emitting diode LED 1, which is preferably green, will be energized. This indicates that the brush 12 is satisfactory.

After the brush 12 has worn to the point where replacement is necessary, the insulation will be worn from the tip of probe 10 to complete a circuit to the case 19. As a result, current may begin flowing in transformer secondary winding 24 to the tuned circuit 26. This provides a gate signal to SCR 1. Because the output of voltage control oscillator 20 is at the tuned frequency of circuit 26, the current is passed through circuit 26 to provide a gate signal to the silicon controlled rectifier SCR. The use of tuned circuit 26 insures that noise or other stray signals will not actuate the SCR. When the SCR fires the relay coil 30 is energized to move contacts 38, 40 to their alternate positions to deenergize LED 1 and actuate the LED flasher circuit 34 causing LED 2 to flash intermittently. In addition, the audio enunciator 44 may also be operated.

After the brush 12 has been replaced, the wear indicator circuit 16 may be reset by opening switch 52 in the SCR anode-cathode circuit. This turns the SCR off and moves the relay contacts 38 and 40 to their normally closed position in engagement with contacts 34 and 41.

While only a single embodiment of the invention has been illustrated and described, it is not intended to be limited thereby but only by the scope of the appended claims.

I claim:

1. A brush wear indicator including a probe associated with a brush, a normally open signal circuit, said probe being constructed and arranged to complete said signal circuit when said brush is worn to a predetermined degree, a trigger circuit including an oscillator for providing a trigger signal at a preselected frequency and an impedance circuit coupled to said oscillator and tuned to the frequency thereof, an indicating circuit operative to provide a brush wear indication, a switching circuit coupled to said trigger circuit and to said indicating circuit, said trigger circuit also including an inductive device in circuit between said oscillator and said switching circuit, said inductive device being unsaturated to provide a high impedance to the trigger signal when said signal circuit is open, said inductive device being saturated on the completion of said signal circuit to provide a low impedance to the trigger signal, said switching circuit being operable to actuate the indicating circuit upon the receipt of a trigger signal.

2. The brush wear indicator set forth in claim 1 wherein said inductive device comprises a transformer having a first winding coupled to said probe and a second winding in circuit between said oscillator and said switching circuit.

3. The brush wear indicator set forth in claim 2 wherein said brush is disposed within a metallic brush holder for positioning the same adjacent a motor commutator, said probe being connected to one end of said first transformer winding and said holder being connected to the other end thereof.

4. The brush wear indicator set forth in claim 1 wherein said switching circuit includes a silicon controlled rectifier having a gate coupled to said trigger circuit and having an anode and cathode circuit coupled to said indicating circuit.

5. The brush wear indicator set forth in claim 1 wherein said indicating circuit includes first and second light emitting diode means and relay means having normally closed contacts for energizing said first light emitted diode means and normally open contacts for preventing the actuation of said second light emitting diode means, said silicon controlled rectifier being operative to step said relay contacts upon receipt of a gate signal.

6. The brush wear indicator set forth in claim 5 and including circuit means for intermittently energizing said second light emitting diode.

7. The brush wear indicator set forth in claim 1 wherein said probe is embedded in said brush and has insulation disposed therearound, one end of said probe being in a position in said brush of maximum wear, the other end of said brush being in circuit with said signal circuit.

8. A brush wear indicator in combination with a brush, said indicator including a probe associated with said brush, a normally open signal circuit, said probe being constructed and arranged to complete said signal circuit when said brush is worn to a predetermined extent, a trigger circuit coupled to said signal circuit and including an oscillator for providing a trigger signal at a preselected frequency an impedance circuit coupled to said oscillator and tuned to the frequency thereof, an indicating circuit operative to provide a brush wear indication, a switching circuit coupled to said trigger circuit and to said indicating circuit, said trigger circuit also including an inductive device coupled to the signal circuit and between said oscillator and said switching circuit, said inductive device presenting a high impedance path to said trigger signal when said signal circuit is open and a low impedance path thereto when said signal circuit is complete, said switching circuit being coupled to the indicating circuit and being operable to actuate said indicating circuit upon the occurence of a trigger signal.

9. The brush wear indicator set forth in claim 8 wherein said probe is embedded in said brush and has insulation disposed therearound, one end of said probes being in a position in said brush of maximum wear, the other end of said probe being in circuit with said trigger circuit.

10. The brush wear indicator set forth in claim 9 wherein said brush is disposed within a metallic brush holder for positioning the same adjacent a motor commutator, said, probe being connected at one end to said inductive device being connected to said holder at its other end.

* * * * *